US006516569B2

(12) United States Patent
Schweitzer

(10) Patent No.: US 6,516,569 B2
(45) Date of Patent: Feb. 11, 2003

(54) DOOR HAVING A DOOR TERMINAL, DOOR WITH A DOOR TERMINAL HAVING A MOUNTING PLATE, AND MOUNTING PLATE FOR A DOOR TERMINAL OF A DOOR

(75) Inventor: Falko Schweitzer, Schwelm (DE)

(73) Assignee: Dorma GmbH + Co. KG, Ennepetal (DE)

( * ) Notice: Subject to any disclaimer, the term of this patent is extended or adjusted under 35 U.S.C. 154(b) by 22 days.

(21) Appl. No.: 09/822,809

(22) Filed: Mar. 26, 2001

(65) Prior Publication Data

US 2002/0148166 A1 Oct. 17, 2002

Related U.S. Application Data

(63) Continuation-in-part of application No. PCT/EP00/06918, filed on Jul. 20, 2000.

(30) Foreign Application Priority Data

Jul. 27, 1999 (DE) ..... 199 34 785

(51) Int. Cl.[7] ..... E06B 3/00

(52) U.S. Cl. ..... 49/503; 49/13; 70/422; 70/DIG. 49; 292/DIG. 65

(58) Field of Search ..... 49/13, 14, 141, 49/279, 280, 503; 292/93, DIG. 65; 70/422, DIG. 49

(56) References Cited

U.S. PATENT DOCUMENTS

| | | | | |
|---|---|---|---|---|
| 2,420,125 A | * | 5/1947 | Crist | 70/422 |
| 4,058,670 A | | 11/1977 | Leschinger | |
| 4,304,070 A | * | 12/1981 | Musacchia | 49/2 |
| 4,598,495 A | * | 7/1986 | Labarile | 49/41 |
| 4,703,962 A | * | 11/1987 | Kelly et al. | 292/DIG. 65 |
| 4,903,513 A | * | 2/1990 | Stobbart | 70/422 |
| 5,191,314 A | | 3/1993 | Ackerman et al. | |
| 5,595,026 A | * | 1/1997 | Licking et al. | 49/360 |
| 6,314,772 B1 | * | 11/2001 | Hohlfelder | 70/161 |

FOREIGN PATENT DOCUMENTS

| | | |
|---|---|---|
| DE | 3841099 | 6/1990 |
| DE | 9408898 | 11/1995 |
| DE | 19652348 | 6/1998 |

OTHER PUBLICATIONS

DORMA TL Typenreihe 40 und Zubehör (catalog excerpt).

* cited by examiner

*Primary Examiner*—Jerry Redman
(74) *Attorney, Agent, or Firm*—Nils H. Ljungman & Associates

(57) ABSTRACT

Door with a door terminal for use with or as part of a door, such as sliding doors, folding doors, pivot-hung doors, and automatic doors. The door terminal can comprise a housing accommodating therein an access opening. The door terminal further comprises a stationary attached mounting plate to which the housing is detachably connected and designed to be essentially tamper-proof. Further development of the door terminal intends to make the installation simple and more universal, therefore the mounting plate presents a pivot bearing and a stopper, and the housing presents a cut free web and a lock operable from the front side. The door terminal can also have a pushbutton to release a locking device, and a protection pane covering the pushbutton.

20 Claims, 10 Drawing Sheets

DOOR HAVING A DOOR TERMINAL, DOOR WITH A DOOR TERMINAL HAVING A MOUNTING PLATE, AND MOUNTING PLATE FOR A DOOR TERMINAL OF A DOOR

The present application is a continuation-in-part of International Application No. PCT/EP00/06918 filed on Jul. 20, 2000, which application claims priority from Federal Republic of Germany Patent Application No. 199 34 785.9, filed on Jul. 27, 1999. International Application No. PCT/EP00/06918 was pending as of the filing of this application. The United States was an elected state in International Application No. PCT/EP00/06918.

BACKGROUND OF THE INVENTION

1. Field of the Invention

The present invention generally relates to door terminals for use with doors, such as sliding doors, folding doors, pivot-hung doors, and automatic doors. As is generally well-known in the art of doors and door terminals, it is often desirable to equip the door with some type of lock or locking mechanism to prevent unauthorized opening of the door in order to restrict access to a room or other building structure. The most commonly used system is a simple lock and key system where only users having a key matching the particular lock may have access to the room. However, it is often desirable to modify, replace, or add to such a simple system if a greater degree of security is required, such as in an office or government facility. For examples, a lock and key system could be used in conjuction with a security card.

Although a lock and key system is often an effective means to restrict access, it is not invulnerable to tampering by an unauthorized person desiring access to the restricted space. To further increase security, the lock system often can be equipped with further protection to help prevent tampering. By substantially enclosing the lock system in a housing or casing, for example, it is possible to substantially secure the lock system so that unauthorized persons cannot physically access the lock system without causing great damage or exerting considerable energy to gain access. By increasing the number of obstacles one must overcome to gain access to the locking mechanism, the chances of unauthorized access are correspondingly reduced.

In addition to increasing the overall security to a lock system at a door, safety of building occupants must also be maintained without sacrificing heightened security. Therefore, it can become necessary to equip the door terminal with a safety mechanism that can permit a user to bypass the locking system simply and quickly in case of an emergency. In an emergency situation, such as a fire in the building, occupants must be able to exit quickly, so a lock system that requires special access measures may endanger occupants by not allowing them to exit through the door if they do not have the required key or code. The door lock system should therefore be equipped with an emergency button or similar device that would bypass the security lock and permit opening of the door.

This invention is further based on a door terminal, which door terminal presents a housing in which are arranged a profile cylinder with an associated electronic circuit board, an audible alarm transmitter and/or visual display means, an emergency pushbutton in connection with a switch block to release a locking device, a protection pane covering the emergency pushbutton and a stationary attached mounting plate at which the housing is detachably mounted and securable by means of a anti-sabotage contact.

This invention is also based on a door terminal with an emergency pushbutton. The door terminal has.a profile cylinder with an associatedelectronic circuit arrangement, an audible alarm transmitter and/or visual display means and an emergency pushbutton in connection with a switch block to release a locking device are located within a housing of the door terminal, whereby a protection pane arranged in a covering frame covers the emergency pushbutton.

2. Background of the Invention

Such door terminals are employed as compact equipment in emergency exits in access controlled environments. Such a door terminal has been launched under the designation "DORMA TLG". Such a door terminal type is known from German patent 196 52 348 A1. A stationary mounted housing in the area of the door comprises a profile cylinder, which serves to acknowledge an alarm and to deactivate/activate the door security system. Furthermore, light emitting diodes are integrated into the housing to display the operating condition "locked/unlocked". Moreover the housing comprises an audible alarm transmitter and an emergency pushbutton together with a forced-opening switch block. The housing, attached at a mounting base solidly fastened to the wall, is secured by means of an anti-sabotage contact. The emergency pushbutton is protected against accidental operation by a shatterproof protection hood made from plastic material. In the event of danger after a powerful stroke, the spacers of the a protection hood will brake after a powerful stroke, whereby simultaneously the emergency pushbutton will be pushed down. The door can then be opened almost without any resistance, whereby an audible alarm signal will be released.

The door terminal slides onto the mounting base fixed to the wall and is fastened on the underside to the mounting base. Due to this fastening arrangement, a concealed in-wall mounting, especially with already existing system housings, is very difficult or not possible at all, as the required mounting space is not available. Basically, the accessibility from the underside of the housing is not particularly advantageous with regard to the installer's position during installation. Another problem is that the electric subassemblies mounted in the terminal housing are wired with supply lines already existing on the construction site. For this reason, while executing installation work, the detached door terminal must be fixed or held with one hand, such that further operations can only be executed with the other hand. The existing anti-sabotage contact is arranged on a separate holding bracket and activated by means of the housing's underside attachment. In this case, it is disadvantageous that the attachment of the housing can be dismounted with commercially available tools. The surrounding border of the mounting base requires an adaptation to the housing shape of the terminal, such that for different housing variants a corresponding amount of different mounting bases must be produced.

A door terminal is also known from Federal Republic of Germany patent No. 196 52 348 C2. An emergency pushbutton, as well as visual and audible display means, an electronic circuit arrangement, and an access control insert are located within its housing. The access control insert has been exchangeably executed in a modular manner with the intention to realize different access controlled systems while maintaining the other components. The emergency pushbutton is also covered by means of a shatterproof protection hood.

Moreover Federal Republic of Germany patent U.S. Pat. No. 94 08 898 U1 published a danger warning system presenting audible as well as visual display means. An internally located emergency pushbutton is protected against accidental operation by means of a glass pane, which must be manually destroyed to trigger an alarm signal.

In Federal Republic of Germany patent No. 38 41 099 C2 a door guard is described, where the housing covering the pushbutton has to be pivoted sideways in order to reach the emergency pushbutton. A covering pane prevents an abusive operation of the housing, which pane however has to be destroyed in the event of danger.

The operation of the emergency push-buttons requests, for all terminals known from the aforementioned state of the art, the exchange of the then destroyed cover, which requires, as a result, a corresponding reserve supply expense for new covers and maintenance work resulting therefrom. On the operator side, the maintenance expenditure caused by abusive operation especially is not desired. When utilizing glass covers instead of plastic covers, the hindrance level against abuse is certainly increased, but the basic problem however, i.e. exchanging the destroyed covers, remains unchanged. Nevertheless, practical experience and diverse guidelines recommend a cover for the emergency pushbutton to protect the alarm systems from accidental operation as much as possible.

OBJECT OF THE INVENTION

One possible object of the invention is to develop a door terminal for use with doors, such as sliding doors, folding doors, pivot-hung doors, and automatic doors. Since it is often desirable to equip a door with some type of lock or locking mechanism to prevent unauthorized opening of the door in order to restrict access to a room or other building structure, means to prevent tampering of the lock system become necessary. A further object of the invention is to provide a housing or casing that substantially encloses the lock system to substantially secure the lock system so that unauthorized persons cannot physically access the lock system without causing great damage or exerting considerable energy to gain access.

In addition to increasing the overall security to a lock system at a door, it is an additional object of the invention to maintain safety of building occupants without sacrificing heightened security. A door terminal can be provided with a safety mechanism, such as a pushbutton, that can permit a user to bypass the locking system simply and quickly in case of an emergency to permit easy opening of the door.

Another object of the invention is therefore to further develop a door terminal having features as described above in the field of the invention, such that a simplified and universal installation is possible, whereby optionally an anti-sabotage protection must be realizable. The door terminal should be suitable as well for surface wall mounting as for concealed in-wall mounting.

An additional object of the invention is therefore to further develop a door terminal having features as described above in the field of the invention, such to achieve an optimized and demountable proof arrangement and conception of the protection pane, as to user-friendliness and user-safety, which on the operator side requires little maintenance and installation effort. The door terminal should be suitable as well for surface wall mounting as for concealed in-wall mounting.

SUMMARY OF THE INVENTION

One possible solution according to at least one embodiment of the present invention is to provide a door terminal for use with doors, which door terminal can be used to control access to an area. The door terminal can have means to prevent tampering of the lock system, such as a housing or casing that substantially encloses the lock system to substantially secure the lock system so that unauthorized persons cannot physically access the lock system without causing great damage or exerting considerable energy to gain access.

Another possible solution according to at least one embodiment of the present invention is to provide a door terminal with safety features. A door terminal can be provided with a safety mechanism, such as a pushbutton, that can permit a user to bypass the locking system simply and quickly in case of an emergency to permit easy opening of the door.

Another problem of the invention is solved in that the terminal housing is introduced into a pivot bearing, which is conformed at a mounting plate, and can be fixed by means of a lock on the front side at a stopper on the upper side of the mounting plate. Herewith a possibility is given to exclusively mount the terminal housing through accessibility from the front side with very little displacement. The installation is considerably simplified, whereby especially an installation in narrow mounting spaces is made possible. This mounting situation is particularly found when integrating a door terminal into already existing installation boxes or installation profiles or with a concealed in-wall mounting.

The given mounting space must simply exceed the external dimensions of the door terminal housing by the constructional depth of the pivot bearing. Due to the small dimensions of the pivot bearing, the clearance in mounting space works out at a range of less than a centimeter such that the front side appearance is not impeded by over-dimensioned gaps between the door terminal and the surrounding installation housing.

An anti-sabotage contact can be directly arranged on the circuit board and activated by the stopper of the mounting plate during installation of the housing. Separate holding brackets and supply lines for the anti-sabotage contact are preferably no longer required. The addition of an optional anti-sabotage contact to the door terminal merely requires an exchange of the circuit board, as, due to the stopper, the mounting plate is principally conceived for such expansion variant.

The mounting plate can be attached at the construction site, for example, at a wall, preferably screwed in, whereby mounting openings in the mounting plate are slightly arched in order to essentially guarantee a secure leaning on the wall principally with all installation variants, the housing can be initially moved in the direction of the wall onto the mounting plate, whereby the stopper and the pivot bearing serve as positioning help. Subsequently the housing can be pushed into a preferably C-shaped bearing shell of the pivot bearing, whereby the bearing shell's free end can engage a slot of the housing. It is furthermore possible to swing open the housing for connection operations, whereby the pivot bearing and a web, cut free or separated by the slot, interact. Hereby executions including a vertically- or horizontally-oriented swivelling axis are conceivable. In case of a concealed in-wall mounting, due to the constructional depth of the door terminal, the pivot bearing must be executed in form of a swinging open and/or slide-out bearing variant. The positive engagement of the bearing shell into the slot, in connection with the leaning of the housing on the stopper, provides an essentially exact positioning of the housing with regard to the mounting plate. The exact positioning, particularly with regard to the stopper of the mounting plate, is imperatively required for a reliable functioning of the lock and of the optional anti-sabotage contact provided on the circuit board, which contact for example can be executed as micro switch or as reed contact. The anti-sabotage contact can trigger an alarm signal in the central control room or at the door terminal such that corresponding measures can be taken immediately.

Due to the lock, operable from the front side and the latch of which engages the stopper upon actuation, the housing is demountable-proof or unremovably fixed to the mounting plate, and due to the connection with the bearing shell engaging the housing, neither a horizontal nor a vertical movement of the housing with regard to the mounting plate is possible. The connections between the housing and the mounting plate are executed such that they are inaccessible from outside, and such that an abusive and destruction-free disassembly is excluded. Once the key has been removed, only authorized personnel can open the housing.

Authorized personnel can release the housing from the mounting plate to execute, for example, repair, maintenance or adaptation work. To unlatch the terminal, the lock is unlocked by means of the key and the housing is opened, whereby, in case of surface wall mounting, a web of the housing moves inside the bearing shell such that an articulated connection is built towards the mounting plate. By this articulated connection, the housing is positively held at the mounting plate and its underside sits on the wall. The installer can work with both his hands and in an advantageous working position. The work can be executed comfortably from above and existing electrical connections to wiring provided at the construction site are not subject to any substantial mechanical load.

The terminal housing can completely encompass the mounting plate. Therefore the mounting plate is invisibly arranged or arranged in concealed manner, such that for variants of the housing only one universal mounting plate is used, which has not to be adapted to the different housing's form and color executions. All known locks can be suitable locking devices. Insert locks are particularly advantageous for their simple and robust functioning principle. Especially the simple de-installation and installation in case of a change in locking groups facilitates such remodeling.

Essentially all visual and all audible display components of the terminal can be centrally arranged in one module. Thus, altogether a compact and well-priced unit is conceived, which has been optimized with regard to utilization of the existing space in the housing of the door terminal.

A further problem of the invention is solved in that the emergency pushbutton of a door terminal can be covered by a covering frame equipped with an integral protection pane, which frame is preferably fastened to an associated mounting frame, whereby the protection pane is arranged in a flexible reception on the inside of the covering frame. In the event of an alarm, the protection pane can be non-destructively axially or rotatably removed with a defined operating force and a significant sensible snapping feeling. The emergency pushbutton can be operated via the protection pane at this time freely movable in the direction of operation. Therefore the protection pane may not be destroyed, and, later, maintenance personnel can slide the pane back into its original position. In case of operation, the protection pane can be guided inside the covering frame within a pane shaft and end stoppers prevent it from unwillingly falling out of the pane shaft when unfolding the covering frame. The flexible arrangement of the protection pane within the covering frame may be also realized with consideration to the aspect to reduce damage possibilities and also to reduce the danger of injury for the operator. Glass may be preferred to the variant of plastic material as the threatening danger of injury increases the hindrance level of abusive operation. Basically however, the danger of injury can be essentially excluded, since the protection pane can be executed with sufficient material strength, which, under normal operation conditions, will not substantially splinter.

Generally, essentially any material that is transparent and moreover not destroyed when operated can be used for this protection pane type. Suitable materials tested in practical operation are glass and plastic materials, which can be moreover simply equipped with printed operating instructions or other information.

On the operator side, the reuse of the protection pane and little maintenance effort can be advantageous. Furthermore, already existing systems can be easily retro-equipped with covering frames. The operating force can be adapted to most varying legal or fire protection regulations through different dimensioning of the holding arms executed at the inside of the covering frame.

The holding arms can be preferably cut free or separated at additional opposite longitudinal walls inside the covering frame. The holding arms can present respectively only one flexible resilient connection to the longitudinal wall and an inwardly directed camber. In the non-activated condition, the protection pane can be positioned between the camber and an inner edge of the covering frame. When pressure is exerted, the holding arms can spring outwardly and, over the camber, the protection pane can be pushed onto the emergency pushbutton. While the protection pane moves, the longitudinal walls can build a shaft wherein the protection pane is guided. End stoppers formed at the longitudinal walls limit the movement. Preferably, only maintenance personnel can put the protection pane back in place, as only they are able to unfold the covering frame, secured against abuse, from the mounting frame.

The mounting frame together with the covering frame can build a modular component, whereby the mounting frame is clipped with little pressure into the terminal housing. The clip connections are inaccessibly executed from outside, such that even with an opened covering frame the non-destructive disassembly is excluded. Basically the module is conceived such to be inserted into the housing of the door terminal, when turned by 180° with regard to the flap direction of the covering frame. The electrical and mechanical components of the door terminal are executed to comply with such installation variant.

The unauthorized opening and respectively the removal of the covering frame can be rendered more difficult by using appropriate mechanical means and/or signalized by electrical means which trigger a silent alarm signal in the central control room or on the display module, such that corresponding measures can be taken immediately.

The unfolding covering frame can be pivotably articulately mounted on pivots of the mounting frame. Upon folding, apertures at the freely movable side of the covering frame get into contact with complementary snap hooks of the mounting frame, while at the articulated side of the covering frame protruding extensions engage the terminal housing on the inside. In addition to this, to prevent from abuse, a bolt, which is driven by the profile cylinder, blocks the covering frame. After an activation of the emergency pushbutton, only authorized personnel can reset this blocking. In connection with the protrusions on the articulated side, abusive and non-destructive detaching of the covering frame is thus excluded.

When the bolt is deactivated, an unintentional displacement of the covering frame is essentially prohibited thanks to the catching between the snap hook and the apertures, which moreover essentially guarantee an exact positioning of the covering frame with regard to the mounting frame.

This exact positioning is required for a reliable operation of an optional anti-sabotage contact provided on the circuit board, which contact can be executed for example as a microswitch or reed contact. The anti-sabotage contact is operated via a nose provided at the covering frame.

All visual display means can be likewise and thus centrally integrated into the module. The result is a compact and thus well-priced unit, essentially optimized with regard to utilization of the existing space in the housing of the door terminal. The arrangement of the display module at the emergency pushbutton provides, especially for the service personnel, the possibility to view at a glance all visual displays of the module and, additionally, at the same time, the lighting of the emergency pushbutton.

The exchangeability of the display module, for the producer and respectively for the supplier, reduces the effort to supply reserves and allows retrofitting a basic version at essentially the least possible expense. The complete wiring in the door terminal is executed as standard wiring, such that exchanging a module only requires substantially little adaptation. Moreover the door terminals can have a uniform presentation.

The above-discussed embodiments of the present invention will be described further herein below. When the word "invention" is used in this specfication, the word "invention" includes "inventions", that is the plural of "invention". By stating "invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

BRIEF DESCRIPTION OF THE DRAWINGS

Embodiments of the present invention are explained in more detail on the basis of the embodiment examples more or less diagrammatical represented in the drawings, as follows.

Identical parts or identical working parts are respectively referenced with the same numerals.

Figure 1:
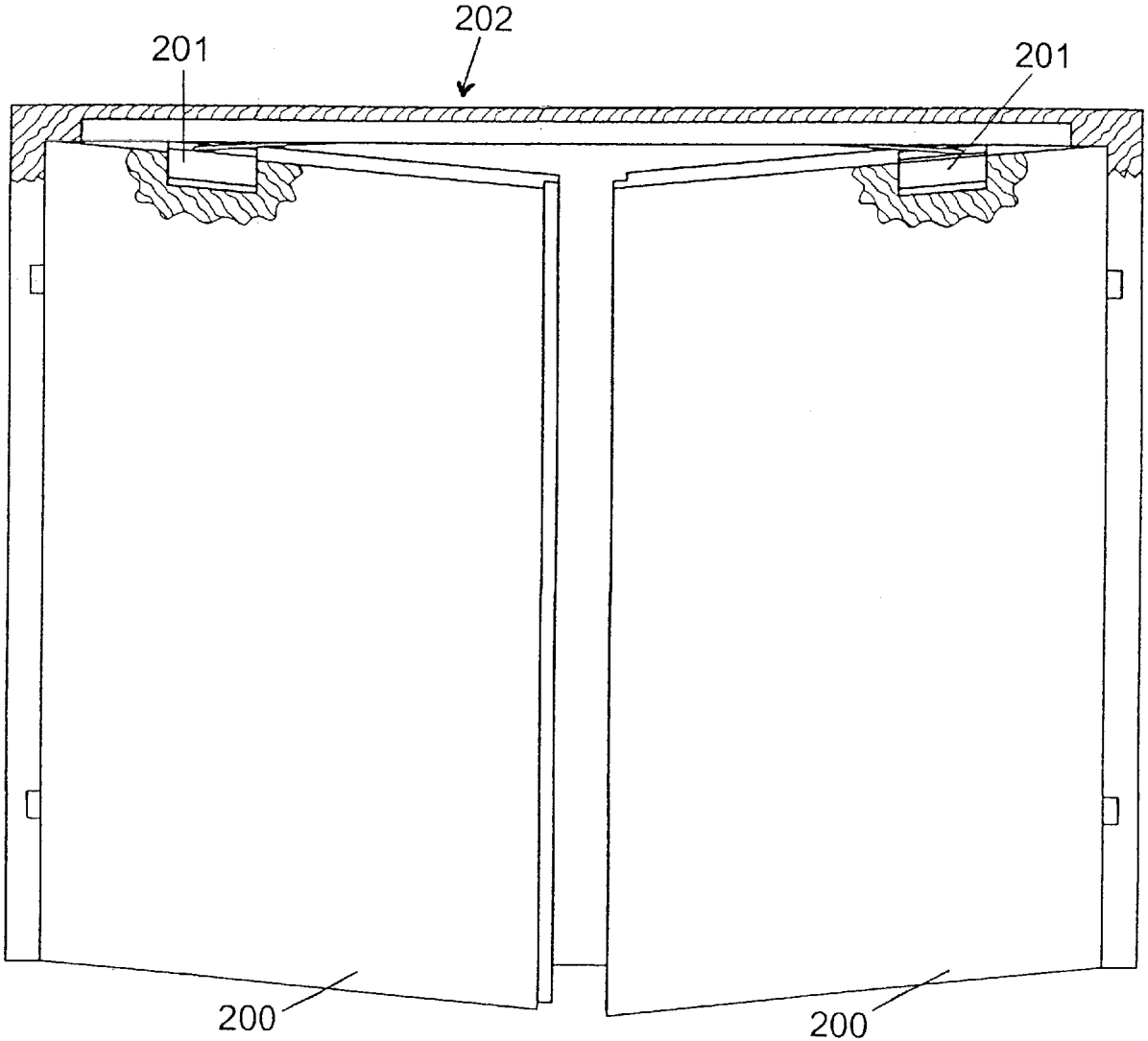
FIG. 1 shows a pivot-hung door.

DESCRIPTION OF THE PREFERRED EMBODIMENT:

FIG. 1 shows a pivot-hung door 202. The pivot-hung door 202 has two door panels or leaves 200. The panels 200 are pivotably hung from their corresponding door closers 201. The panels 200 can be swung back and forth to open or close the opening. In FIG. 1, the panels 200 are pulled slightly away from each other, showing a partially open position of the door 202. The panels 200 can be moved further away from each other to fully open the door. Conversely, the panels 200 may be moved flush against each other to obtain a closed position for the door 202, which door 202 may then be locked to prevent opening by unauthorized persons.

Figure 2:
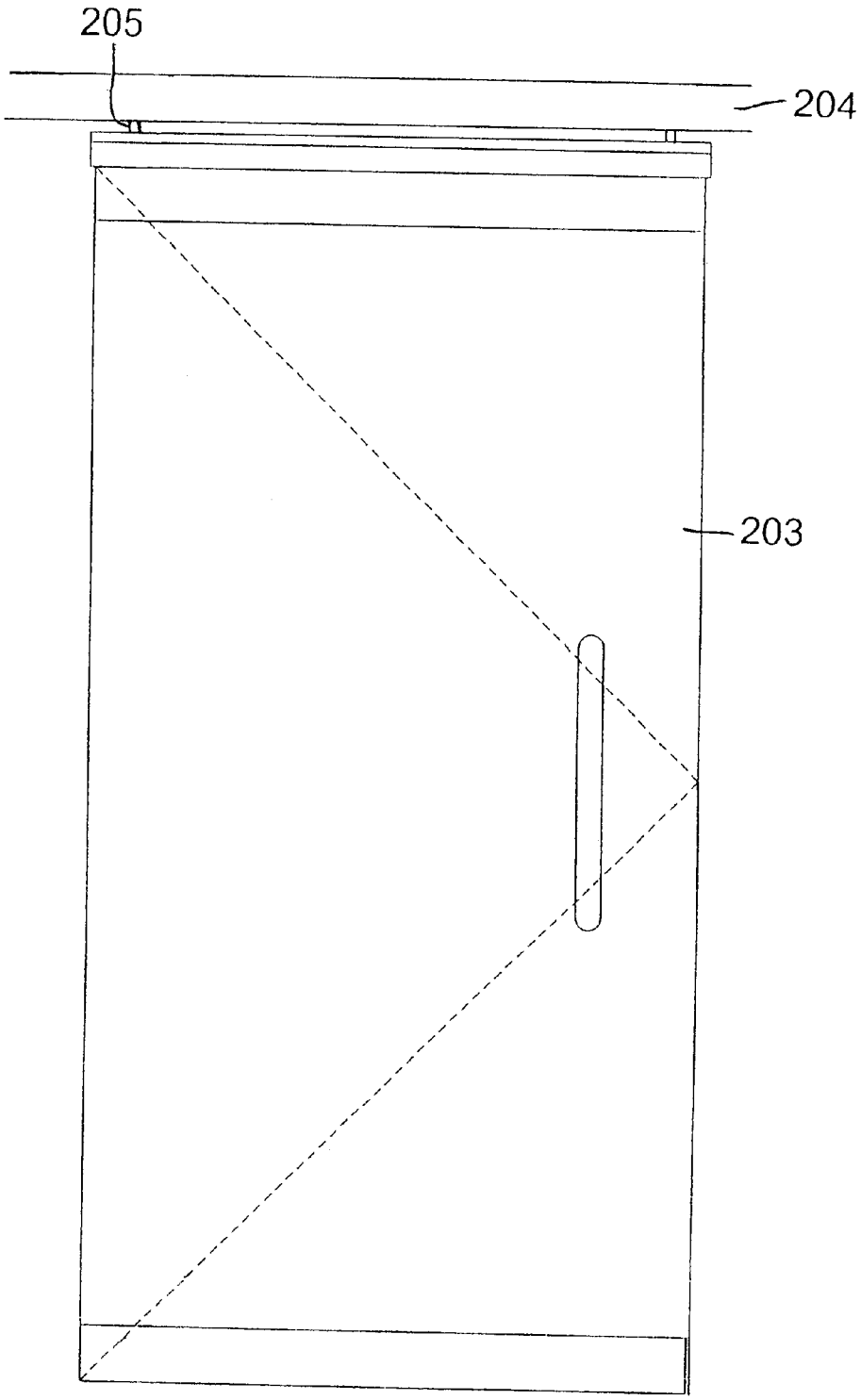
FIG. 2 shows a section of a sliding door.

FIG. 2 shows another type of door, namely a sliding door. The sliding door can comprise one or more movable panels, though only one panel 203 is shown. The panel 203 is hung from a bearing or carrier structure 205. The bearing 205 is supported by a guide structure 204, which is connected to or part of a ceiling structure (not shown). The bearing 205 engages the guide structure 204 such that the panel 203 may be moved along the guide structure 204 to open or close an opening. The movement of the panel 203 may be done manually by an authorized user, or may be executed automatically via a drive system (not shown) operatively connected to the panel 203.

Figure 3:
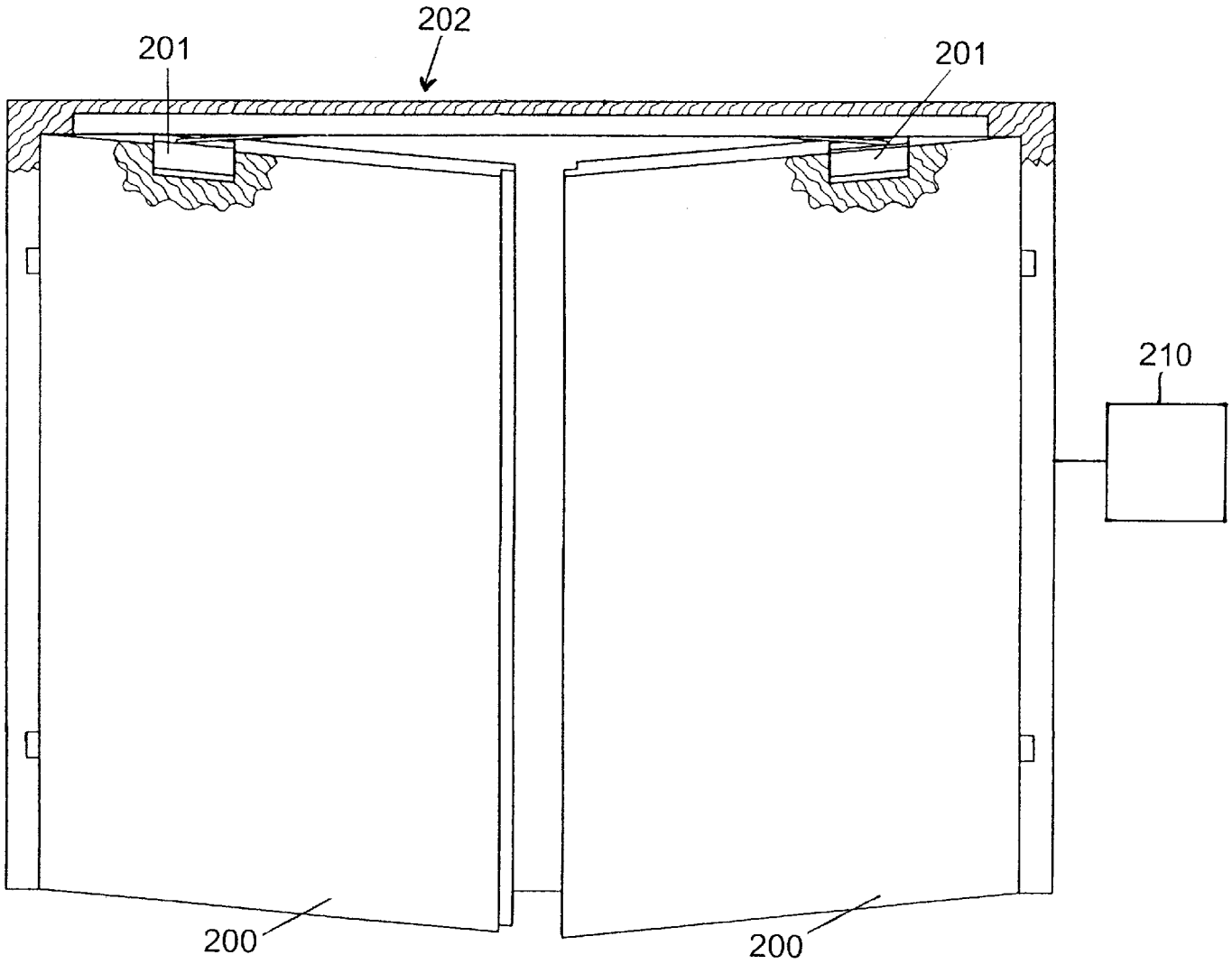
FIG. 3 shows the pivot-hung door of FIG. 1 with a door terminal.

FIG. 3 shows the pivot-hung door 202 as shown in FIG. 1, with additional features. Specifically, FIG. 3 shows a door terminal 210 operatively or directly connected to the pivot-hung door 202. The door terminal 210 can be configured in a manner as described herein. The door terminal 210 can be designed to restrict access through the door 202 by controlling the operation of a locking mechanism used to lock the door 202 upon the door 202 being in a closed position. Authorized users may access the door terminal 210 to unlock and open the door 202. The door terminal 210 may also have an emergency pushbutton to provide emergency opening of the door 202.

Figure 4:
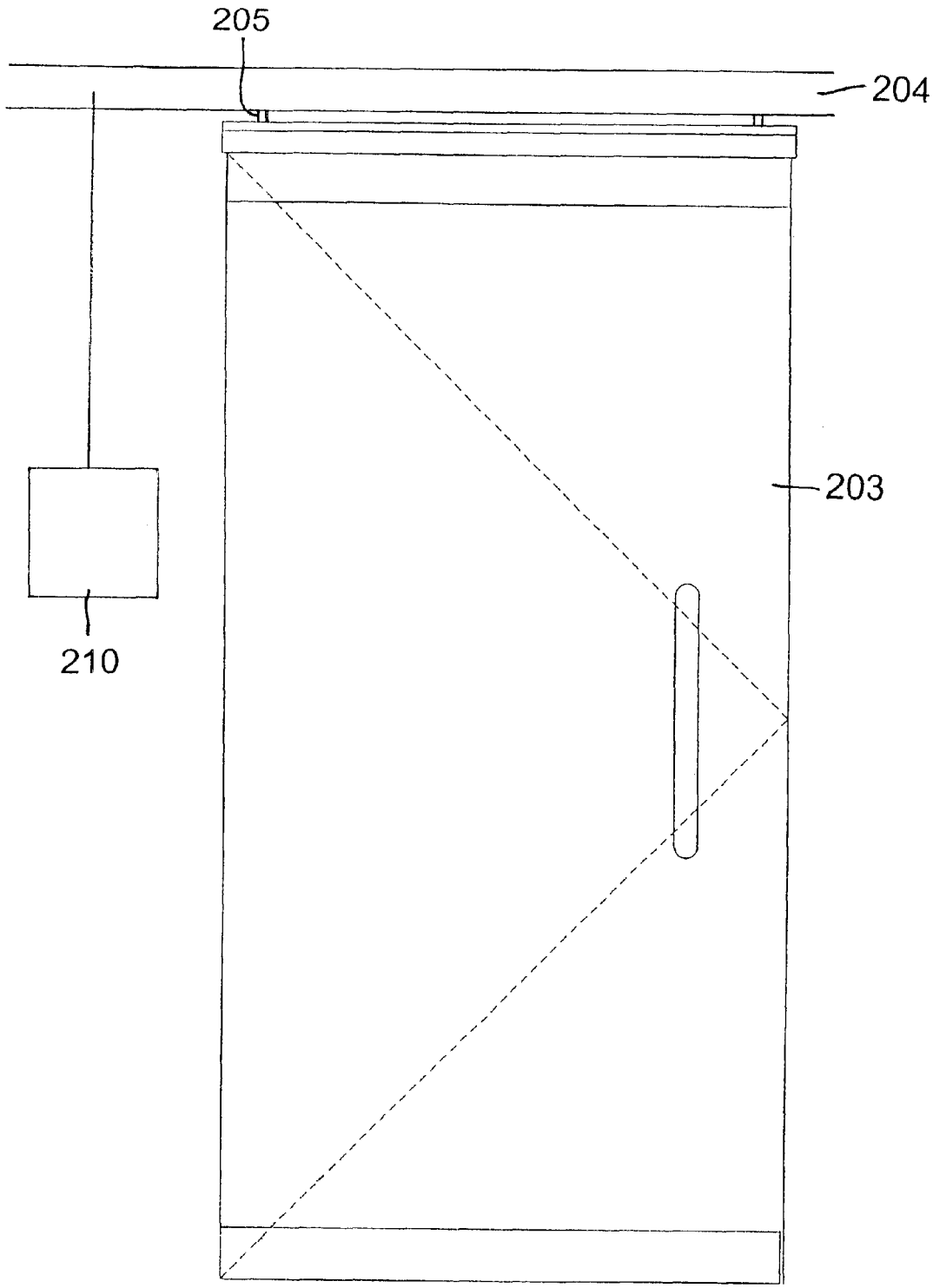
FIG. 4 shows the sliding door of FIG. 2 with a door terminal operatively connected to it.

FIG. 4 shows the sliding door as shown in FIG. 2, with additional features. Specifically, FIG. 4 shows a door terminal 210, as shown in FIG. 3 and described herein, operatively or directly connected to the sliding door.

Figure 10:
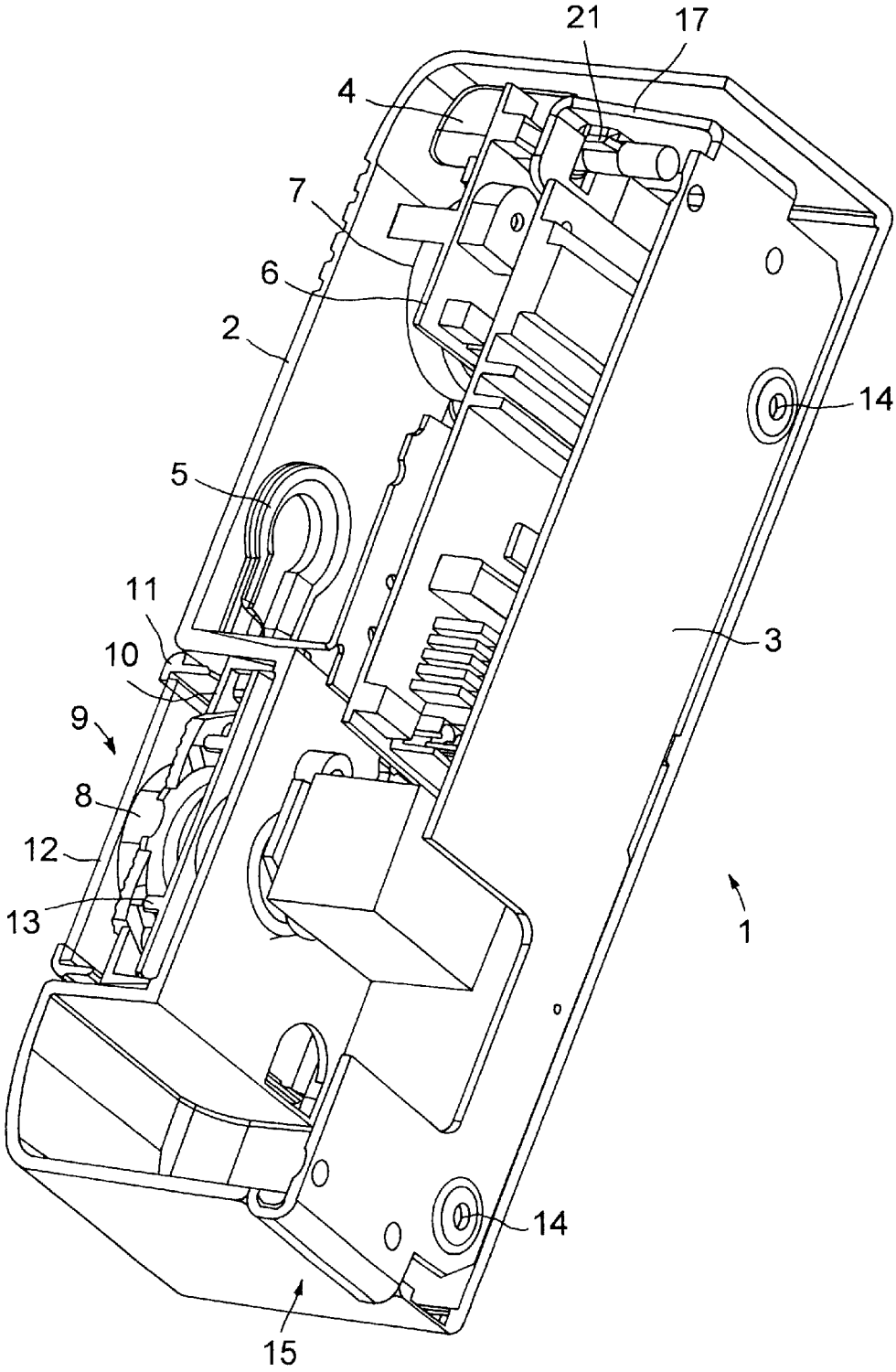
FIG. 10 shows a longitudinal section of a door terminal including a mounting plate.

FIG. 10 displays the basic construction of a door terminal 1. The door terminal 1 is arranged next to the door in a so-called surface wall installation, whereby the housing 2 is fixed to a stationary mounted mounting plate 3. Within the housing 2 are located a lock 4 and a schematically illustrated profile cylinder 5, serving for the acknowledgment of an alarm and for the deactivation/activation of a door security system, which cylinder is actively connected to the circuit board 6. Furthermore an audible alarm transmitter 7 and an emergency pushbutton 8 together with a non-illustrated forced-opening switch block are accommodated within the housing 2. An exchangeable module 9 encompasses the emergency pushbutton 8, which module includes a holding frame 10 and a thereto-associated covering frame 11 with integral protection pane 12. As an option, all visual display means 13 can be integrated into this module 9.

In the event of an alarm, the protection pane 12 is removed from its original position by means of a defined operating force and the emergency pushbutton 8 is thereby subsequently operated. The hereby-triggered signal, while transmitting an audible and/or visual alarm, produces the opening release of the corresponding door.

Figure 5:
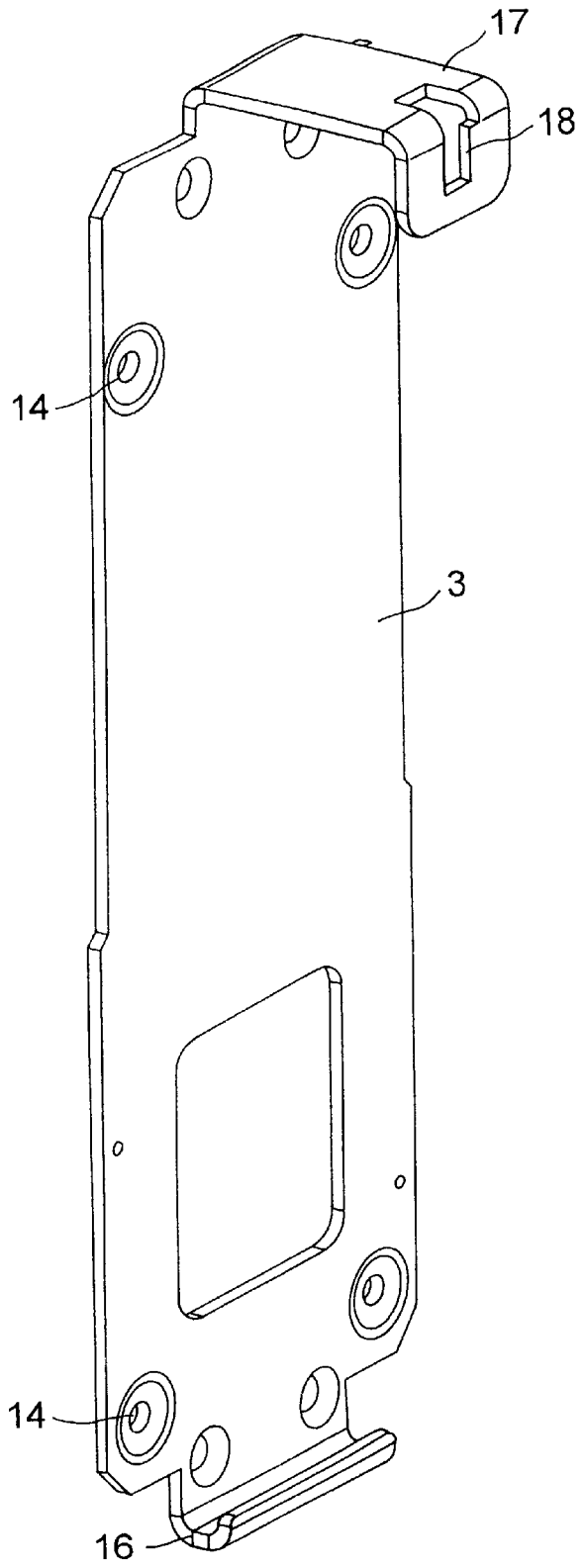
FIG. 5 shows a longitudinal section of the mounting plate.

The housing 2 of the door terminal 1 is made from die casting material and is lacquered green for example, whereas the single-piece mounting plate 3 can be stamped from metal, which is further galvanized to prevent corrosion. The mounting plate 3 is screwed at the construction site for example to a wall, whereby mounting openings 14, as can be seen in FIG. 5, in the mounting plate 3 are slightly arched with the intention to guarantee a secure leaning even on an irregular surface. On its underside, including an extending C-shaped bearing shell 16, and is provided on its upper side with an angled L-shaped stopper 17 executed with an undercut 18.

In case the door terminal 1 is surface wall mounted, the underside of the housing 2 is lowered onto the bearing shell 16 of the pivot bearing 15 and swung, whereby the bearing shell's 16 free-end engages a slot 19 of the housing 2. Once the required connecting work between the subassemblies of the housing 2 and the mounting plate 3 is completed, the housing 2 is swung back onto the mounting plate 3.

Figure 9:
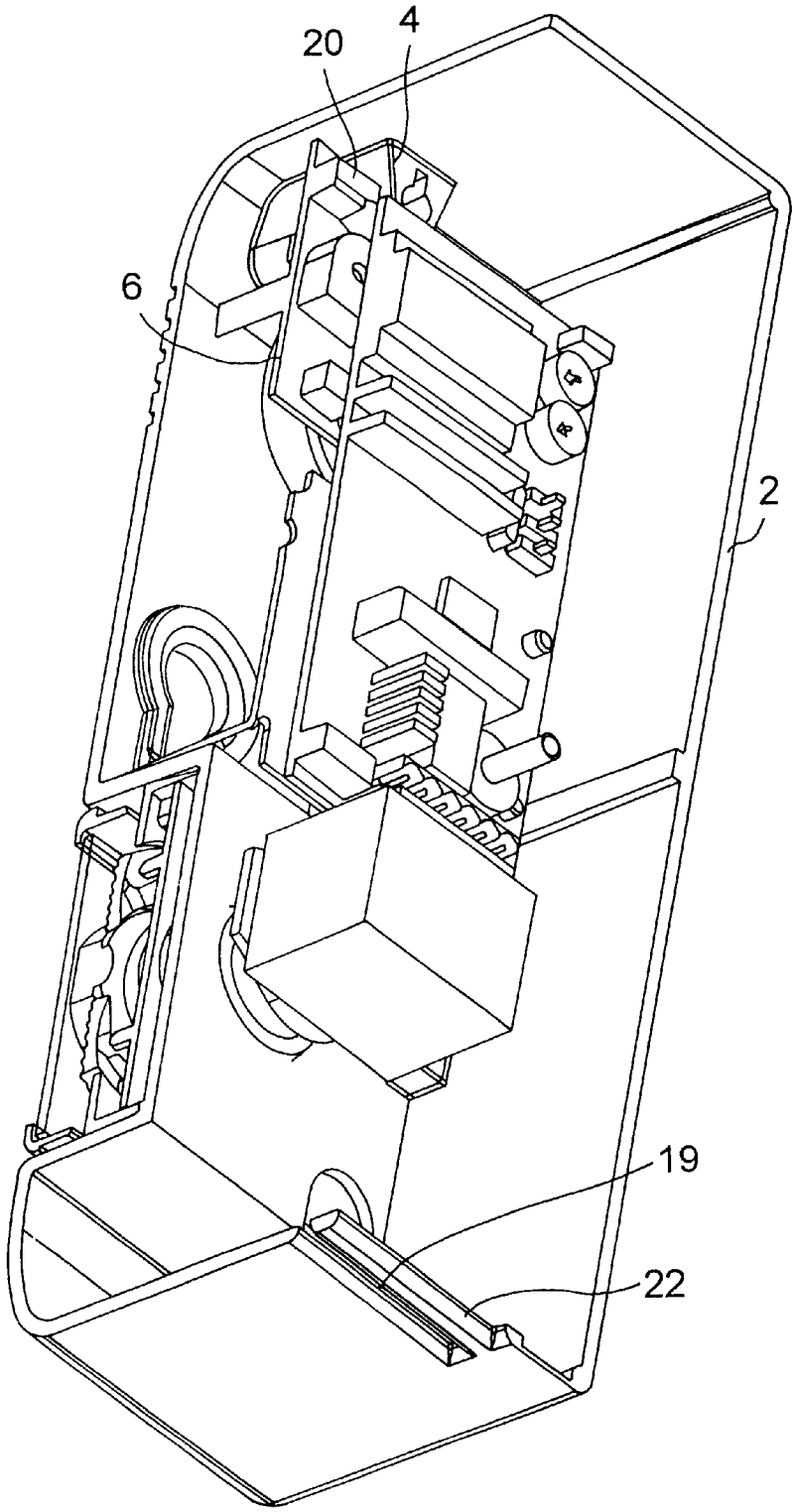
FIG. 9 shows a longitudinal section of the door terminal.

Hereby, the stopper 17 of the mounting plate 3 and the bearing shell 16 serve as positioning help. The positive engagement of the bearing shell 6 in the slot 19, in connection with the leaning of the housing 2 on the stopper 17, guarantees an exact positioning and thus a reliable functioning of the lock 4 and of an optional anti-sabotage contact 20 provided on the circuit board 6 (FIG. 9). The anti-sabotage contact 20 is activated by means of the stopper 17 and can be executed for example as micro-switch or as reed contact. The anti-sabotage contact 20 triggers an alarm signal in the central control room or directly at the door terminal 1 such that appropriate measures can be taken immediately.

Due to the lock 4 operable from the front side, which latch 21, upon operation of a non-illustrated key, engages an undercut the mounting plate 3. In connection with the bearing shell 16 engaging the housing 2, the housing 2 can neither move horizontally nor vertically with regard to the mounting plate 3. The connections between the housing 2 and the mounting plate 3 are executed such that they are inaccessible from the outside, and such that an abusive and destruction-free disassembly is excluded. Once the key has been removed, only authorized personnel can open the housing 2.

Only authorized personnel can remove the housing 2 from the mounting plate 3, in order to execute for example repair, maintenance or adaptation work. To open up the door terminal 1, the lock 4 is unlocked by means of the key and the housing 2 is swung open to below. In this case, cut free or separated by the slot 19, a web 22 of the housing 2 moves within the bearing shell 16 in a way that an articulated connection is built towards the mounting plate 3. This articulated connection positively holds the housing 2 at the mounting plate 3 and with its underside the housing props up on the wall. The installer can work with both his hands and in an advantageous working position. Operations can be executed comfortably from above. Existing electrical connections to construction-site provided wiring are not subject to any mechanical load.

Figure 6:
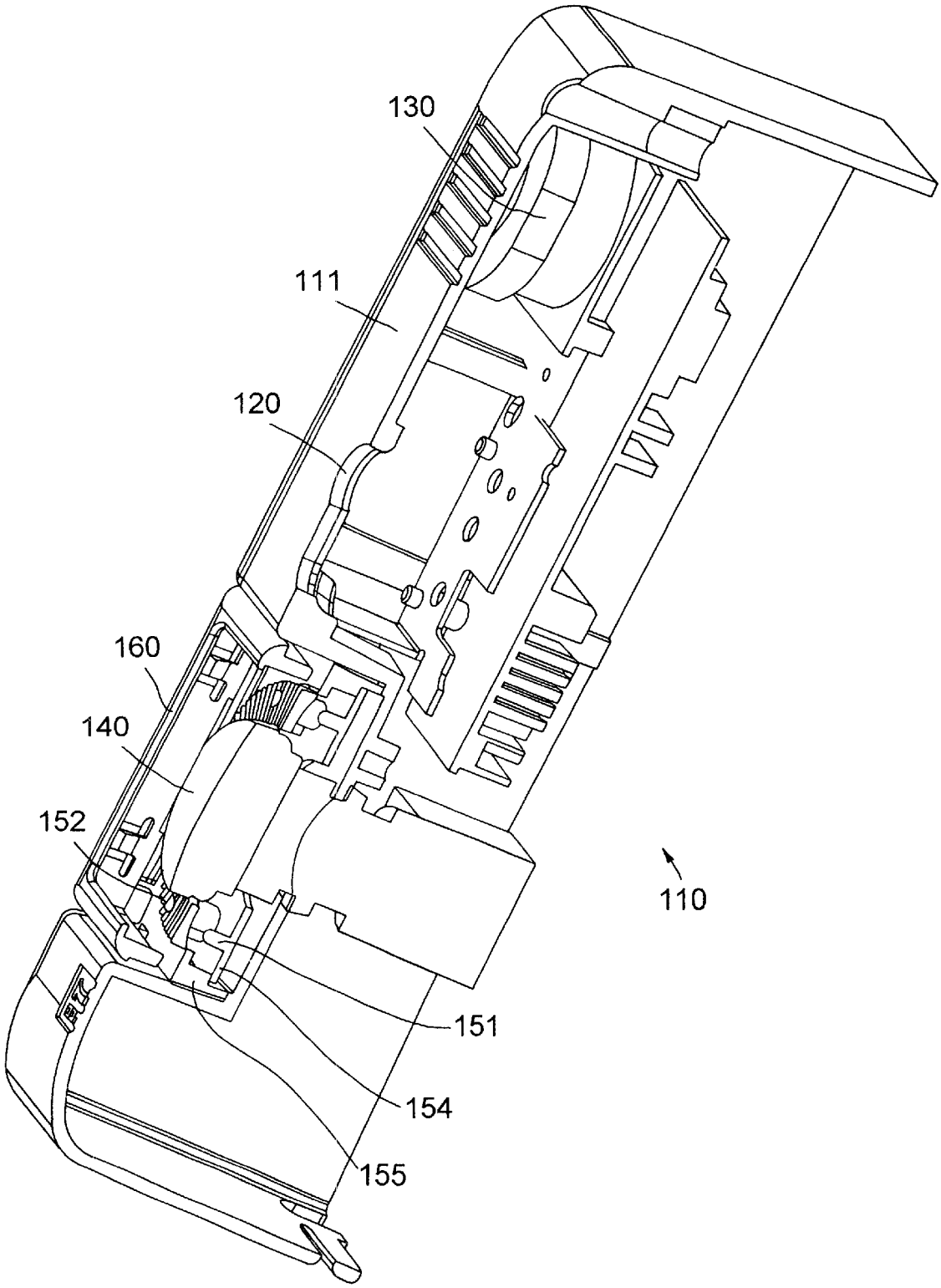
FIG. 6 shows a longitudinal section of a door terminal in non-activated condition.

FIG. 6 illustrates the principal conception of a door terminal 110. A profile cylinder 120, serving to acknowledge an alarm signal and to de-activate/activate a door security system, is located within a housing 111 that is stationary mounted next to the door. Within the housing 111 are furthermore accommodated an audible alarm transmitter 130 and an emergency pushbutton 140 together with a non-illustrated forced opening switch block. For the purpose of quick localization of the door terminal 110, the emergency pushbutton 140 is illuminated and the housing 111 is for example lacquered green. The housing 111, arranged on a base, which is positively and non-positively connected to the wall, is secured by means of an anti-sabotage contact. A display module 150 is inserted into the housing 111 of the door terminal 110 and connected to the basic circuit by means of non-illustrated plug-in connections. The display module 150 consists of a rectangular circuit board 154 on which display means 151 are arranged in a circle, for example in form of light emitting diodes of different colors and flashing lights. A light ring 152, arranged around the emergency pushbutton 140, and light bars 153, attached on the outside of a mounting frame 155, diffuse the light. This equipped circuit board 154 is included within the mounting frame 155. A covering frame 160 with therein arranged protection pane 161, closes the mounting frame 155, such that a complete display module 150 is created. The mounting frame 155 and the covering frame 160 are made from transparent material.

Figure 7:
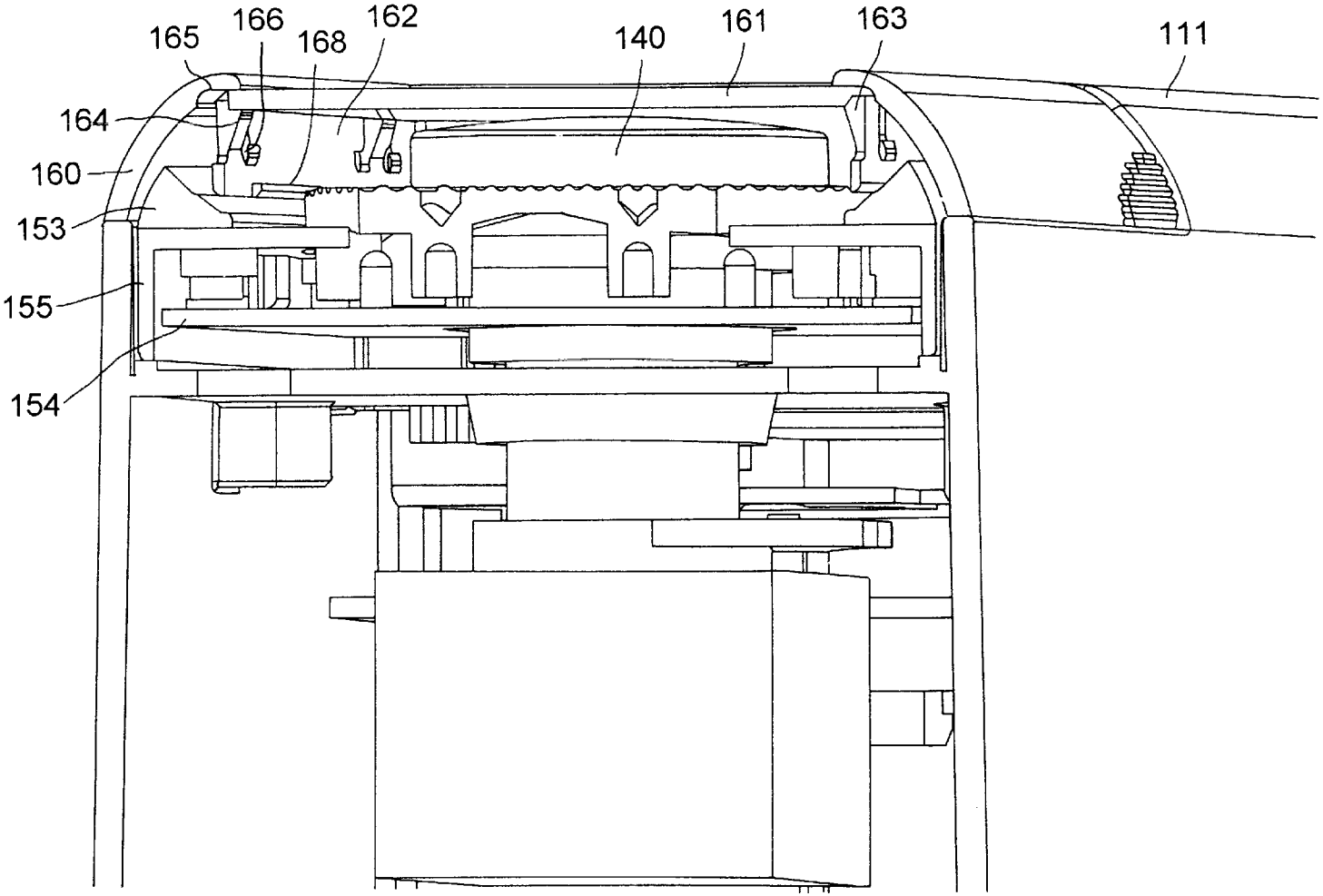
FIG. 7 shows an enlarged section of FIG. 6.

The covering frame 160 is pivotably articulately mounted at the mounting frame 155 and presents on the inside two opposite longitudinal walls 162. Two holding arms 163 are cut free or separated from each longitudinal wall 162, which arms are executed with inwardly oriented cambers 164. In the non-actuated position (FIG. 7), the protection pane 161 is located between the cambers 164 and an inner edge 165 of the covering frame 160.

Figure 8:
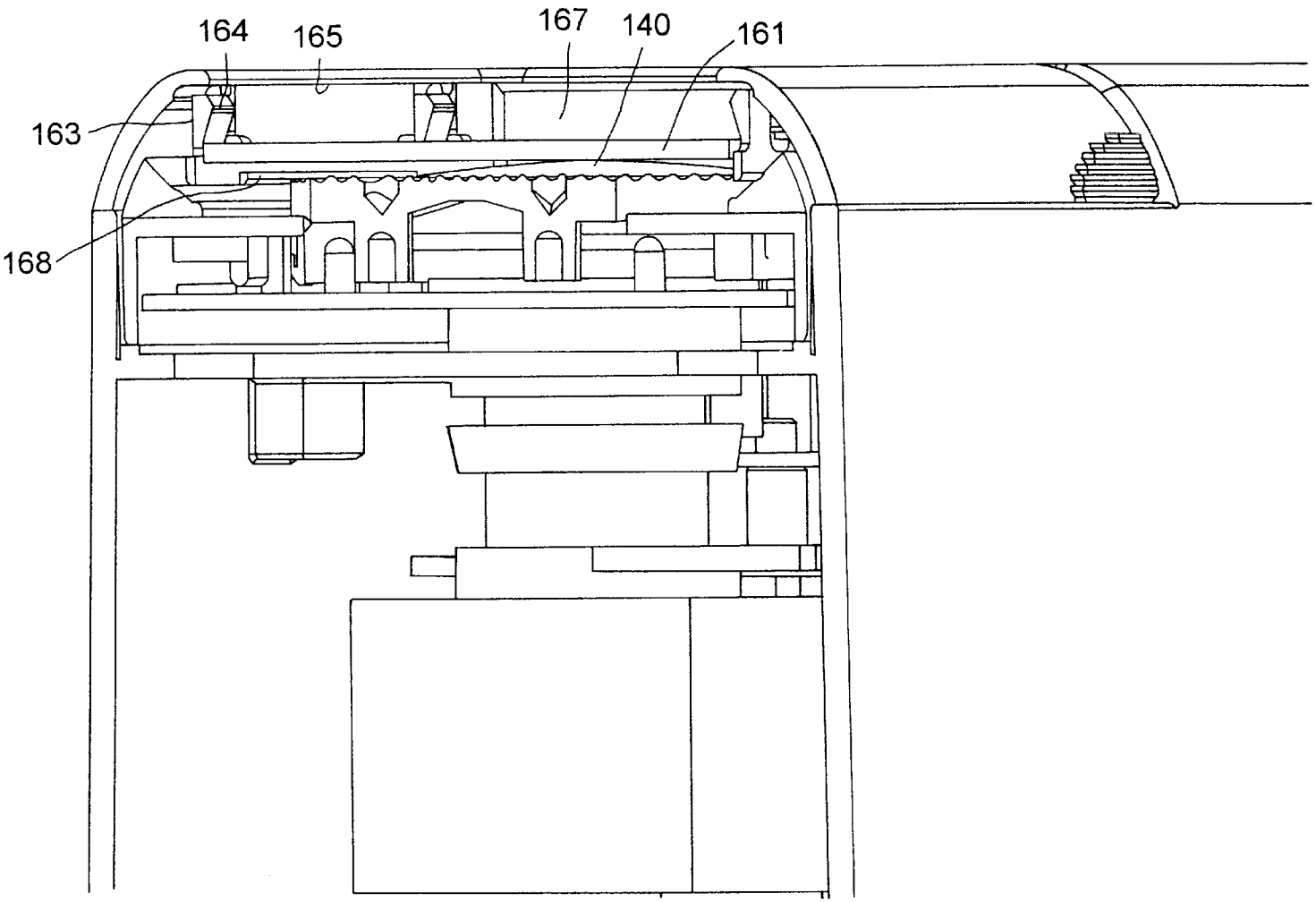
FIG. 8 shows an enlarged section according to FIG. 7 in activated condition.

In the event of an alarm, the protection pane 161 is axially destruction-free removed from its original position with a defined operating force and with a clearly sensible snapping feeling (FIG. 8). The emergency pushbutton 140 is operated via the protection pane 161, at this time freely movable in an operating direction. When pressure is exerted, the holding arms 163 spring outwardly in free cuts 166 and, via the cambers 164, the protection pane 161 can be pushed onto the emergency pushbutton 140. While the protection pane 161 is moving, the longitudinal walls 162 build a shaft 167 in which the protection pane 161 is guided. End stoppers 168 at the longitudinal walls 162 limit the movement.

The hereby-triggered signal transmits on the one hand an audible and on the other hand a visual alarm. The visual alarm signal is realized by means of display means 151, whereby the emitted light is especially reflected and diffused via the light guides 152, 153.

Only authorized personnel can move the protection pane 161 back into the original position, as only they are able to detach the covering frame 160, which is secured against abuse, from the mounting frame 155. Via a microswitch (non-illustrated) arranged between the covering frame 160 and the mounting frame 155, the abusive detaching of the covering frame 160 triggers a silent alarm signal in a central control room and/or a corresponding signal on the display module 150. As far as mechanical safety devices are provided between the covering frame 160 and the mounting frame 155 respectively the housing 111, the abusive detaching can only be achieved by destroying the corresponding component. Authorized personnel can open the covering frame 160 without triggering a signal. The microswitch is deactivated or activated via an additional key position of the profile cylinder 210.

The housing 111, which is suitable for surface wall mounting and concealed in-wall mounting is conceived such that all required connections for the operation of the different display modules 150 are provided and that the display modules 150 can be interchanged by authorized personnel.

One feature of the invention resides broadly in a door terminal with a housing (2), wherein are located: a profile cylinder (5) with an associated electronic circuit board (6), an audible alarm transmitter (7) and/or visual display means (13), an emergency pushbutton (8) in connection with a switch block for the release of a locking device, a protection pane (12) covering the emergency pushbutton (8) and a stationary fixed mounting plate (3) at which the housing (2) is detachably attached and securable by means of an anti-sabotage contact (20), characterized in that the mounting plate (3) presents a pivot bearing (15) and a stopper (17) and in that the housing (2) presents a cut free web (22) and a lock (4) operable from the front side.

Another feature of the invention resides broadly in a door terminal characterized in that the pivot bearing (15) through its underside and the stopper (17) through its upper side are arranged at the mounting plate (3), and the cut free web (22) through its underside and the front side operable lock (4) through its upper side are arranged at the housing (2).

Yet another feature of the invention resides broadly in a door terminal characterized in that an anti-sabotage contact (20) is directly arranged on the circuit board (6) mounted within the housing (2) and can be activated by means of the stopper (17).

Still another feature of the invention resides broadly in a door terminal characterized in that the pivot bearing (15) presents a C-shaped bearing shell (16).

A further feature of the invention resides broadly in a door terminal characterized in that the stopper (17) extends in L shape from the mounting plate (3).

Another feature of the invention resides broadly in a door terminal characterized in that the stopper (17) presents an undercut (18).

Yet another feature of the invention resides broadly in a door terminal characterized in that the housing (2) completely covers the mounting plate (3).

Still another feature of the invention resides broadly in a door terminal characterized in that the mounting plate (3) is executed as a single piece and stamped.

A further feature of the invention resides broadly in a door terminal characterized in that the lock (4) is an insert lock.

Another feature of the invention resides broadly in a door terminal, characterized in that an exchangeable module (9) arranged on the front side is executed with a lockable covering frame (11 ) presenting a protection pane (12) and with a holding frame (10) and is optionally equipped with all visual display means (13).

One feature of the invention resides broadly in a door terminal with a housing (111), wherein are located: a profile cylinder (120) with an associated electronic circuit arrangement, an audible alarm transmitter (130) and/or visual display means (151) and an emergency pushbutton (140) in connection with a switch block for the release of a locking device, whereby a protection pane (161) provided in a covering frame (160) covers the emergency pushbutton (140), characterized in that the protection pane (161) is non-destructively movable within the covering frame (160).

Another feature of the invention resides broadly in a door terminal characterized in that the protection pane (161) is reversibly movable within the covering frame (160).

Yet another feature of the invention resides broadly in a door terminal characterized in that the covering frame (160) is executed with holding arms (163) which are internally arranged and flexibly outwardly springing.

Still another feature of the invention resides broadly in a door terminal characterized in that the holding arms (163) present a camber (164).

A further feature of the invention resides broadly in a door terminal characterized in that the covering frame (160) presents end stoppers (168).

Another feature of the invention resides broadly in a door terminal characterized in that the holding arms (163) and the end stoppers (168) are executed at opposite longitudinal walls (162) of the covering frame (160).

Yet another feature of the invention resides broadly in a door terminal characterized in that the protection pane (161) is made from glass.

Still another feature of the invention resides broadly in a door terminal characterized in that the covering frame (160) is pivotably articulately attached at a mounting frame (155).

A further feature of the invention resides broadly in a door terminal characterized in that the covering frame (160) together with the mounting frame (155) builds a modular exchangeable unit.

Another feature of the invention resides broadly in a door terminal characterized in that the covering frame (160) is mechanically securable against unauthorized removal respectively detaching and/or unauthorized removal respectively detaching can be electrically signalized.

The invention also relates to a door terminal (1) with a housing (2) accommodating therein a profile cylinder (5) with an associated electronic circuit board (6), an audible alarm transmitter (7) and/or visual display means (13), an emergency pushbutton (8) in connection with a switch block to release a locking device, a protection pane (12) covering the emergency pushbutton (8) and a stationary attached mounting plate (3) to which the housing (2) is detachably connected and securable by means of an anti-sabotage contact (20). Further development of the door terminal (1) intends to make the installation simple and more universal, whereby an optional anti-sabotage contact can be realized, therefore the mounting plate (3) presents a pivot bearing (15) and a stopper (17) and the housing (2) presents a cut free web (22) and a lock (4) operable from the front side.

The invention further relates to a door terminal (110) with a housing (111) accommodating therein a profile cylinder (120) with an associated electronic circuit arrangement, an audible alarm transmitter (130) and/or visual display means (151) and an emergency pushbutton (140) in connection with a switch block to release a locking device, whereby a protection pane (161), provided in a covering frame (160), covers the emergency pushbutton (140). Further development of the door terminal (110) intends to achieve an optimized and demountable-proof arrangement and conception of the protection pane (161) with regard to user-friendliness and user-safety, which on the operator side requires little maintenance and installation effort, therefore the protection pane (161) is non-destructively movable within the covering frame (160).

The components disclosed in the various publications, disclosed or incorporated by reference herein, may be used in the embodiments of the present invention, as well as equivalents thereof.

The appended drawings in their entirety, including all dimensions, proportions and/or shapes in at least one embodiment of the invention, are accurate and are hereby included by reference into this specification.

All, or substantially all, of the components and methods of the various embodiments may be used with at least one embodiment or all of the embodiments, if more than one embodiment is described herein.

All of the patents, patent applications and publications recited herein, and in the Declaration attached hereto, are hereby incorporated by reference as if set forth in their entirety herein.

The corresponding foreign and international patent publication applications, namely, Federal Republic of Germany patent Application No. 199 34 785.9, filed on Jul. 27, 1999, having inventor Falko SCHWEITZER, and International Application No. PCT/EP00/06198 filed on Jul. 20, 2000, as well as their published equivalents, and other equivalents or corresponding applications, if any, in corresponding cases in the Federal Republic of Germany and elsewhere, and the references cited in any of the documents cited herein, are hereby incorporated by reference as if set forth in their entirety herein.

Additional foreign and international patent publication applications, namely, Federal Republic of Germany patent Application No. 199 34 482.5, filed on Jul. 27, 1999, having inventor Falko SCHWEITZER, and International Appln. No. PCT/EP00/06950 of Jul. 20, 2000, as well as their published equivalents, and other equivalents or corresponding applications, if any, in corresponding cases in the Federal Republic of Germany and elsewhere, and the references cited in any of the documents cited herein, are hereby incorporated by reference as if set forth in their entirety herein.

The following U.S. patent applications are hereby incorporated by reference as if set forth in their entirety herein: Ser. No. 09/134,661, filed on Aug. 14, 1998, having inventors Armin HEESE and Manfred KAMPMANN; and Serial No. filed on Mar. 26, 2001, having inventor Falko SCHWEITZER and Attorney Docket No. NHL-DOR-95.

The following U.S. and foreign patents or patent publications are hereby incorporated by reference as if set forth in its entirety herein, as follows: U.S. Pat. No. 5,191,314, issued on Mar. 2, 1993 to inventors Ackerman, et al.; U.S. Pat. No. 4,058,670, issued on Nov. 15, 1997 to inventor Leschinger; Federal Republic of Germany No. DE 38 41 099 A1; Federal Republic of Germany No. DE 196 52 348 A1; Federal Republic of Germany No. DE 196 52 348 C2; Federal Republic of Germany No. DE 94 08 898 U1; France Publication No. 2 749 961; and European Application No. 92303567.9.

The following publication is hereby incorporated by reference: "DORMA TL Typenreihe 40 und Zubehör", published by DORMA GmbH & Co. KG, Breckerfelder Strasse 42-48, D-58256, Ennepetal, Federal Republic of Germany.

The details in the patents, patent applications and publications may be considered to be incorporable, at applicant's option, into the claims during prosecution as further limitations in the claims to patentably distinguish any amended claims from any applied prior art.

The following documents contain examples of security terminals and/or components or devices that may be used in or with security terminals, which may be used in or in conjunction with at least one embodiment of the present invention: U.S. Pat. No. 5,337,043 issued on Aug. 9, 1994 to A. Gokcebay; Federal Republic of Germany Pat. No. DE 295 10 880 U1, published on Jul. 11, 1996; Federal Republic of Germany Patent No. DE 195 31 323 A1, published on Apr. 18, 1996, inventor J. Rothenburg; Federal Republic of Germany Patent No. DE 295 00 196.8 published on May. 18, 1995; Federal Republic of Germany Patent No. DE 40 17 934 C2, published on Jan. 2, 1992; International Patent Application No. PCT/CH89/00070, filed on Apr. 12, 1989, entitled "Electric Transmission Device," and corresponding publication WO 89/10651 published on Nov. 2, 1989; International Patent Application No. PCT/US87/02794 filed on Oct. 23, 1997, entitled "Interchangeable personality Modules for a Computer Terminal," and corresponding publication WO 88/0328 published May 5, 1988; International Patent Application No. PCT/IT91/00100, filed on Nov. 22, 1991, entitled "Safety Lock with Multiple Operation with Emergency Manual Intervention Facility", and corresponding publication WO 92/09773 published Jun. 11, 1992; European Patent No. EP 0 441 237 A1, published on Aug. 14, 1991; U.S. patent application Ser. No. 08/644,537, filed on May 10, 1996, having inventor Gerhard Kirchhoff, entitled (as amended) "Security Structure with Electronic Smart Card Access thereto with Transmission of power and Data Between the Smart Card and the Smart Card Reader performed Capacitively or Inductively," which U.S. application claims priority from the Federal Republic of Germany Patent Application No. 44 32 324.7 filed Sep. 13, 1994 and DE 44 32 324.7; the article "Kommunikationstechnik mit Aufgabenzugewinn, published in "elektrobürse" dated Sep. 1990; and the following brochures published by DORMA GmbH & Co-. KG: "CODIC-die Zutrittskontrolle, die elektronische Intelligenz in perfekter Weise mit mechanischem Schutz verbindet"; "Zusatzmodul DORMA ZM 101", WN050561, 10/91, ZM 101, D, 7 B 1/94 Atelier G. Heinz; "Türterminal DORMA TL 62", WN050556 , 10/92,_62, D, 7 B 1/94 Atelier G. Heinz; "Rettungswegzentralen DORMA RZ 01 und RZ 11" WN 050042, 10/88, RZ, D, 7. B. 1/94; Türterminals DORMA TL Typenreihe 40"; "Turverriegelung DORMA TV Typenreihe 100"; Steuer-,Anzeige- und Alarmeinrichtungen"; "Zusatzmodul DORMA ZM 102" WN050584, 11/19, ZM102, D, 7 B 1/94, Atelier G. Heinz; and "Zusatzmodul DORMA ZM 201", WN050544, 6/91, ZM201, D, 7 B 1/94, Atelier G. Heinz. These document are hereby incorporated by reference as if set forth in their entirety herein.

Examples of plug-in connections or components or circuitry related thereto which might be used in conjunction with at least one embodiment of the present invention may be found in U.S. Pat. Nos. 5,295,846 issued on Mar. 22, 1994 to Sumida, et al.; 5,454,730 issued on Oct. 3, 1995 to T. Tozuka; 5,460,548 issued on Oct. 24, 1995 to M. Roth; 5,382,176 issued on Jan. 17, 1995 to A. Norden; 5,383,799 issued on Jan. 24, 1995 to p. Fladung; 5,385,486 issued on Jan. 31, 1995 to D. Robinson, et al.; 5,393,942 issued on Feb. 28, 1995 to R. Reiner, et ano; 5,397,253 issued on Mar. 14, 1995 to H. Fries; 5,398,405 issued on Mar. 21, 1995 to I. Jasch; 5,429,525 issued on Jul. 4, 1995 to p. McCoy; 5,437,564 issued on Aug. 1, 1995 to J. Lignelet; 5,393,241 issued on Feb. 28, 1995 to M. Honda, et al.; 3,137,535 issued in June 1964 to Collier et al.; 4,812,133 issued in March 1989 to Fleak et al.; 4,915,649 issued in April 1990 to Shimazu et al.; 4,938,710 issued in July 1990 to Aihara et al.; 4,842,541 issued in June 1989 to Leandris; 4,655,527 issued in April 1987 to Van Dame; 4,593,965 issued in June 1986 to July; and 3,179,738 issued in April 1965 to DeLyon.

Some examples of alarm systems which may be utilized in accordance with the embodiments of the present invention may be found in the following U.S. Pat. No. 5,374,936 entitled "Security System"; U.S. Pat. No. 5,115,224 entitled "personal Security System Network" to Detection Systems; and U.S. Pat. No. 5,191,314 entitled "Combination Antitheft Lock and Alarm" to pacific West Industries.

Some examples of card readers which may be utilized in accordance with one or more embodiments of the present invention may be found in the following U.S. Pat. No. 5,257,414 entitled "Apparatus for Accepting and Retaining a Memory Card" to Motorola; U.S. Pat. No. 5,291,006 entitled "Authenticity Identifying System for Information Storage Cards" to NHK Springs; and U.S. Pat. No. 5,373, 146 entitled "Card Based Access System with Reader Updating of the Memory".

Some examples of voice identification systems which may be utilized in accordance with at least one embodiment of the present invention may be found in the following U.S. Pat. No. 5,214,699 entitled "System for Decoding and Displaying personalized Identification Stored on Memory Storage Device" to Audio Digital Imaging; U.S. Pat. No. 5,241,649 entitled "Voice Recognition Method" to Matsushita; and U.S. Pat. No. 5,268,963 entitled "System for Encoding personalized Identification for Storage on Memory Storage Devices" to Audio Digital Imaging.

Additional examples of personal identification systems which may be utilized in accordance with embodiments of the present invention may be found in the following U.S. Pat. No. 5,291,560 entitled "Biometric personal Identification System Based on Iris Analysis"; U.S. Pat. No. 5,187, 748 entitled "Optical Apparatus for Fingerprint Identification System" to Goldstar; U.S. Pat. No. 5,210,588 entitled "Fingerprint Identification Apparatus for Enhancing Identification performance"to Goldstar; and U.S. Pat. No. 5,363, 453 entitled "Non-minutiae Automatic Fingerprint Identification System and Methods" to TMS Inc.

Some examples of antennas and transponders which may be utilized in accordance with one or more embodiments of the present invention may be found in the following U.S. Pat. No. 5,347,263 entitled "Electronic Identifier Apparatus and Method Utilizing a Single Chip Microcontroller and an Antenna Coil" to Gnuco; U.S. Pat. No. 5,266,942 entitled "Security System with Memory in Transmitter and Receiver" to Stoller; U.S. Pat No. 5,371,719 entitled "High Security Ultrasonic Receiver Apparatus" to Sentry; and U.S. Pat. No. 5,185,611 entitled "Compact Antenna-Array for Diversity Applications" to Motorola.

Some examples of LEDs and operating indicators which may be utilized in accordance with the present invention may be found in the following U.S. Pat. No. 5,216,287 entitled "Electronic, preferably Zero-contact Switch"to Werner Turck; U.S. Pat. No. 5,268,635 entitled "Intelligent Self-Diagnosing and Sparing Light Emitting Diodes" to AT&T; and U.S. Pat. No. 5,331,333 entitled "Display Apparatus" to Sharp Kabushiki Kaisha.

Some examples of high-strength plastics and metals which may be utilized in accordance with the embodiments of the present invention may be found in the following U.S. Pat. No. 5,229,177 entitled "Multi-directional, Light-weight, High-strength Interlaced Material" to Quadrax; U.S. Pat. No. 5,330,594 entitled "Method of Making Cold Formed High-Strength Steel parts" to Consolidated Metal products, Inc.; and U.S. Pat. No. 5,179,244 entitled "Reinforced Soft and Hard Body Armor". Some examples of smart cards and key cards which may be used in conjunction with at least one embodiment of the present invention are to be found in U.S. Pat. No. 5,198,643, issued to Miron et al. on Mar. 30, 1993 and entitled "Adaptable Electronic Key and Lock System"; U.S. Pat. No. 5,204,663, issued to Lee on Apr. 20, 1993 and entitled "Smart Card Access Control System"; U.S. Pat. No. 5,241,161 issued to Zuta on Sep. 31, 1993 and entitled "Smart Card Integrated in a Wristwatch and Having Logic Unit Controlling the Automatic-Identification process and the Data Transfer"; U.S. Pat. No. 5,255,430, issued to Tallaksen on Oct. 26, 1993 and entitled "Method of Assembling a Module for a Smart Card"; U.S. Pat. No. 5,311,396, issued to Steffen on May 10, 1994 and entitled "Smart Card Chip-Based Electronic Circuit"; U.S. Pat. No. 5,331,138, issued to Saroya on Jul. 19, 1994 and entitled "Hybrid Card Reader"; U.S. Pat. No. 5,341,140, issued to perry on Aug. 23, 1994 and entitled "Transponder System"; U.S. Pat. No. 5,341,428, issued to Schatz on Aug. 23, 1994 and entitled "Multiple Cross-Check Document Verification System"; U.S. Pat. No. 5,422,634, issued to Okubo on Jun. 6, 1995 and entitled "Locking System Using a Key Including an IC Memory"; U.S. Pat. No. 5,477,041, issued to Miron et al. on Dec. 19, 1995 and entitled "Adaptable Electronic Key and Lock System"; U.S. Pat. No. 5,380,991, issued to Valencia et al. on Jan. 10, 1995 and entitled "paperless Coupon Redemption System and Method Thereof"; U.S. Pat. No. 5,404,580, issued to Simpson et al. on Apr. 4, 1995 and entitled "Radio Having Memory Means for Storing Radio User Validation Code"; U.S. Pat. No. 5,412,564, issued to Ecer on May 2, 1995 and entitled "System and Method for Diet Control"; U.S. Pat. No. 5,426,701, issued to Herrmann et al. on Jun. 20, 1995 and entitled "Cable Television Converter Box with a Smart Card Connector Underneath"; U.S. Pat No. 5,436,971, issued to Armbrust et al. on Jul. 25, 1995 and entitled "Method of and Ciricuit Atrrangemnt for Checking a Smart Card"; U.S. Pat. No. 5,446,266, issued to Beuk et al. on Aug. 29, 1995 and entitled "Security System for an Apparatus"; U.S. Pat. No. 5,461,217, issued to Claus on Oct. 24, 1995 and entitled "Secure Money Transfer Techniques Using Smart Cards"; U.S. Pat. No. 5,470,260, issued to Schwan et al. on Nov. 28, 1995 and entitled "Smart Card Connector"; and U.S. Pat. No. 5,471,045, issued to Geronimi on Nov. 28, 1995 and entitled "Smart Card Locking process".

Examples of tamper-proof contacts and/or tamper sensors and components thereof, which may be used with at least one embodiment of the present invention may be found in U.S. Pat. No. 5,381,824 issued on Jan. 17, 1995 to Y. Wang and W. Orozco; U.S. Pat. No. 5,431,381 issued on Jul. 11, 1995 to O. Smed; U.S. Pat. No. 5,469,613 issued on Nov. 28, 1995 to C. McMills, et ano.; U.S. Pat. No. 5,408,212 issued on Apr. 18, 1995 to C. Meyers, et al.; U.S. Pat. No. 5,411,534 issued on May 2, 1995 to A. Dieken, et al.; U.S. Pat. No. 5,418,686 issued on May 23, 1995 to A. Dieken, et al.; U.S. Pat. No. 5,396,215 issued on Mar. 7, 1995 to T. Hinkle; and U.S. Pat. No. 5,463,371 issued on Oct. 31, 1995 to R. Fuller.

The components disclosed in the various publications, disclosed or incorporated by reference herein, may be used in the embodiments of the present invention, as well as, equivalents thereof.

The invention as described hereinabove in the context of the preferred embodiments is not to be taken as limited to all of the provided details thereof, since modifications and variations thereof may be made without departing from the spirit and scope of the invention.

What is claimed:

1. A door for restricting access to an area, said door comprising:

a door frame;

said door frame being disposed in an opening;

at least one door panel;

said at least one door panel being movably mounted in said door frame to permit opening andclosing of said at least one door panel;

a locking mechanism;

said locking mechanism being configured to permit locking and unlocking of said at least one door panel to control the opening and closing of said at least one door panel;

a door terminal;

said door terminal comprising:
a mounting plate;
said mounting plate being fixed to one of: said door frame or an adjacent building structure;
a box-shaped housing;
said housing being movably and detachably connected to said mounting plate and configured to hinge away from said mounting plate;
said housing comprising a.top surface and a bottom surface disposed opposite said top surface;
said housing comprising a front surface disposed between said top surface and said bottom surface;
an unlocking device being disposed in said housing;
said unlocking device being operatively connected to said locking mechanism to permit unlocking of said locking mechanism upon said locking mechanism being locked;
said unlocking device comprising a pushbutton;
said pushbutton being configured to be pushed to activate said unlocking device to unlock said at least one door panel;
said unlocking device further comprising a protective cover plate to protect said pushbutton from accidental operation;
an alarm being disposed in said housing;
said alarm being operatively connected to said pushbutton and being configured to emit an audible sound upon pushing of said pushbutton;
said housing comprising a switch between said housing and said mounting plate to permit detection of unauthorized movement of said housing away from said mounting plate;
said housing comprising a profile cylinder being disposed in said front surface and being configured to permit access into said housing to permit:
(a) deactivation of said switch between said housing and said mounting plate to permit authorized movement of said housing away from said mounting plate, and
(b) activation of said switch between said housing and said mounting plate to permit detection of unauthorized movement of said housing away from said mounting plate;
said mounting plate comprising a curve lip which forms an elongated channel with a substantially U-shaped cross-section;
said elongated channel having a length, a width, and a depth;
said length being substantially greater than said width and said depth;
said bottom surface of said housing having an elongated slot opening disposed adjacent an edge of said bottom surface;
said slot opening and said edge of said bottom surface together defining an elongated web portion being configured to engage with said curved lip of said mounting plate to align said housing with said mounting plate and to permit pivoting of said housing with respect to said mounting plate;
said housing being configured to be supported on said curved lip of said mounting plate, and to rest against one of: said door frame or an adjacent building structure, upon movement of said housing away from said mounting plate to permit a service technician to perform service work on said door terminal without the service technician having to support said housing by manually holding said housing;
said mounting plate comprising a stop;
said housing comprising a latch;
said housing being configured to rest against and be positioned by said stop; and
said latch being configured to rest against said stop to secure said housing to said mounting plate to prevent unauthorized movement of said housing away from said mounting plate.

2. The door according to claim 1, wherein:
said mounting plate has a first end and a second end disposed opposite said first end;
said stop is disposed on said first end;
said curved lip is disposed on said second end;
said latch is disposed in said housing adjacent said top surface of said housing;
said housing comprises a circuit board;
said switch is disposed on said circuit board;
said switch is configured and disposed to contact said stop to activate said switch; and
said curved lip has a C-shaped cross-section.

3. The door according to claim 2, wherein:
said stop extends in an L-shape from said mounting plate;
said stop comprises an undercut portion;
said housing is configured to enclose and cover said mounting plate;
said mounting plate is a single stamped piece;
said latch comprises an insert lock;
said unlocking device comprises an interchangeable module disposed in said front surface of said housing about said pushbutton; and
said interchangeable module comprises:
said protective cover plate;
a covering frame disposed about said protective cover plate and configured to hold said protective cover plate;
a mounting frame disposed about said pushbutton and configured to mount said interchangeable module in said housing; and
visual display means configured to visually display door operating status information.

4. A door for restricting access to an area, said door comprising:
a door frame;
said door frame being disposed in an opening;
at least one door panel;
said at least one door panel being movably mounted in said door frame to permit opening and closing of said at least one door panel;
a locking mechanism;
said locking mechanism being configured to permit locking and unlocking of said at least one door panel to control the opening and closing of said at least one door panel;
a door terminal;
said door terminal comprising:
a mounting plate;
said mounting plate being fixed to one of: said door frame or an adjacent building structure;
a box-shaped housing;
said housing being movably and detachably connected to said mounting plate and configured to hinge away from said mounting plate;
said housing comprising a first surface and a second surface disposed opposite said first surface;

an unlocking device disposed in said housing and being configured to be manually actuated by a user;

said unlocking device being operatively connected to said locking mechanism to permit unlocking of said locking mechanism upon said locking mechanism being locked;

said mounting plate comprising a curved lip which forms an elongated channel with a substantially U-shaped cross-section;

said elongated channel having a length, a width, and a depth;

said length being substantially greater than said width and said depth;.

said second surface of said housing having an elongated slot opening disposed adjacent an edge of said second surface;

said slot opening and said edge of said second surface together defining an elongated web portion being configured to engage with said curved lip of said mounting plate to align said housing with said mounting plate and to permit pivoting of said housing with respect to said mounting plate;

said housing comprising a latch to secure said housing to said mounting plate to prevent unauthorized movement of said housing away from said mounting plate; and said housing being configured to be supported on said curved lip of said mounting plate, and to rest against one of: said door frame or an adjacent building structure, upon movement of said housing away from said mounting plate to permit a service technician to perform service work on said door terminal without the service technician having to support said housing by manually holding said housing.

5. The door according to claim 4, wherein:

said curved lip has a C-shaped cross-section;

said unlocking device comprises a pushbutton;

said pushbutton is configured to be pushed to activate said unlocking device to unlock said at least one door panel;

said mounting plate comprises a stop;

said housing is configured to rest against and be positioned by said stop; and said latch is configured to rest against said stop.

6. The door according to claim 5, wherein:

said housing comprises a switch between said housing and said mounting plate to detect unauthorized removal of said housing; and said housing comprises a profile cylinder disposed in said front surface and configured to permit access into said housing to permit:

(a) activation of said switch between said housing and said mounting plate to detect unauthorized removal of said housing, and (b) deactivation of said switch between said housing and said mounting plate to detect unauthorized removal of said housing to permit authorized removal of said housing.

7. The door according to claim 6, wherein:

said housing comprises a front surface disposed between said first surface and said second surface;

said door terminal comprises an alarm disposed in said housing;

said alarm is operatively connected to said pushbutton and is configured to emit an audible sound upon pushing of said pushbutton;

said unlocking device comprises an interchangeable module disposed in said front surface of said housing about said pushbutton; and said interchangeable module comprises:

said protective cover plate to protect said pushbutton from accidental operation;

a covering frame disposed about said protective cover plate and configured to hold said protective cover plate;

a mounting frame disposed about said pushbutton and configured to mount said interchangeable module in said housing; and visual display means configured to visually display door operating status information.

8. The door according to claim 7, wherein:

said mounting plate has a first end and a second end disposed opposite said first end;

said stop is disposed on said first end;

said curved lip is disposed on said second end;

said latch is disposed in said housing adjacent said top surface of said housing;

said housing comprises a circuit board;

said switch is disposed on said circuit board;

said switch is configured and disposed to contact said stop to activate said switch;

said stop extends in an L-shape from said mounting plate;

said stop comprises an undercut portion;

said housing is configured to enclose and cover said mounting plate;

said mounting plate is a single stamped piece; and said latch comprises an insert lock.

9. A door for restricting access to an area, said door comprising:

a door frame;

said door frame being disposed in an opening;

at least one door panel;

said at least one door panel being movably mounted in said door frame to permit opening and closing of said at least one door panel;

a locking mechanism;

said locking mechanism being configured to permit locking and unlocking of said at least one door panel to control the opening and closing of said at least one door panel;

a door terminal;

said door terminal comprising:

a mounting plate;

said mounting plate being fixed to one of: said door frame or an adjacent building structure;

a box-shaped housing;

said housing being movably connected to said mounting plate and configured to hinge away from said mounting plate;

said housing comprising a first surface and a second surface disposed opposite said first surface;

said mounting plate comprising a curved lip which forms an elongated channel with a substantially U-shaped cros-ssection;

said elongated channel having a length, a width, and a depth;

said length being substantially greater than said width and said depth;

said second surface of said housing having an elongated slot opening disposed adjacent an edge of said second surface; and said slot opening and said edge of said second surface together defining an elongated web portion being configured to engage with said curved lip of said mounting plate to align said housing with said mounting plate and to permit pivoting of said housing with respect to said mounting plate.

10. The door according to claim 9, wherein:

said housing is configured to be supported on said curved lip of said mounting plate, and to rest against one of: said door frame or an adjacent building structure, upon movement of said housing away from said mounting plate to permit a service technician to perform service work on said door terminal without the service technician having to support said housing by manually holding said housing.

11. The door according to claim 10, wherein said door terminal further comprises:

an unlocking device disposed in said housing; and said unlocking device is operatively connected to said locking mechanism to permit unlocking of said locking mechanism upon said locking mechanism being locked.

12. The door according to claim 11, wherein:

said mounting plate comprises a stop;

said housing comprises a latch;

said housing is configured to rest against and be positioned by said stop; and said latch is configured to rest against said stop to secure said housing to said mounting plate to prevent unauthorized movement of said housing away from said mounting plate.

13. The door according to claim 12, wherein:

said curved lip has a C-shaped cross-section.

14. The door according to claim 13, wherein:

said unlocking device comprises a pushbutton; and said pushbutton is configured to be pushed to activate said unlocking device to unlock said at least one door panel.

15. The door according to claim 14, wherein:

said unlocking device further comprises a protective cover plate to protect said pushbutton, from accidental operation; and said housing comprises a switch disposed between said housing and said mounting plate to detect unauthorized removal of said housing.

16. The door according to claim 15, wherein:

said mounting plate has a first end and a second end disposed opposite said first end;

said stop is disposed on said first end;

said curved lip is disposed on said second end; and said latch is disposed in said housing adjacent said top surface of said housing.

17. The door according to claim 16, wherein:

said housing comprises a front surface disposed between said first surface and said second surface;

said housing comprises a profile cylinder disposed in said front surface and configured to permit access into said housing to permit:

(a) activation of said switch between said housing and said mounting plate to detect unauthorized removal of said housing, and (b) deactivation of said switch between said housing and said mounting plate to detect unauthorized removal of said housing to permit authorized removal of said housing.

18. The door according to claim 17, wherein:

said unlocking device comprises an interchangeable module disposed in said front surface of said housing about said pushbutton; and said interchangeable module comprises:

said protective cover plate;

a covering frame disposed about said protective cover plate and configured to hold said protective cover plate;

a mounting frame disposed about said pushbutton and configured to mount said interchangeable module in said housing; and visual display means configured to visually display door operating status information.

19. The door according to claim 18, wherein:

said stop extends in an L-shape from said mounting plate;

said stop comprises an undercut portion;

said housing is configured to enclose and cover said mounting plate;

said mounting plate is a single stamped piece; and said latch comprises an insert lock.

20. The door according to claim 19, wherein:

said door terminal comprises an alarm disposed in said housing;

said alarm is operatively connected to said pushbutton and is configured to emit an audible sound upon pushing of said pushbutton;

said housing comprises a circuit board;

said switch is disposed on said circuit board; and said switch is configured and disposed to contact said stop to activate said switch.

* * * * *

UNITED STATES PATENT AND TRADEMARK OFFICE

CERTIFICATE OF CORRECTION

PATENT NO. : 6,516,569 B2
DATED : February 11, 2003
INVENTOR(S) : Falko Schweitzer It is certified that error appears in the above-identified patent and that said Letters Patent is hereby corrected as shown below:

Column 1,
Line 29, after “For” delete “examples,” and insert -- example, --.

Column 2,
Line 2, after “has” delete “.”.
Line 3, after the first occurrence of “an”, delete “associatedelectronic” and insert -- associated electronic --.
Line 27, after the second occurrence of “the” delete “a”.
Line 66, after “patent” delete “U.S.”.

Column 4,
Line 49, after “wall” insert -- . --.
Line 50, before “with”, delete “principally” and insert -- Principally --.

Column 9,
Line 9, after “underside,” insert -- the mounting plate 3 is provided with a pivot bearing 15 --.
Line 34, after “undercut” insert -- 18 of the stopper 17, the housing 2 is demountable-proof fixed to --.

Column 14,
Line 54, after the first occurrence of “to”, delete “July;” and insert -- Joly; --.
Line 61, after “to”, delete “pacific” and insert -- Pacific --.

Column 16,
Line 60, after “opening”, delete “andclosing” and insert -- and closing --.

Column 17,
Line 9, after “comprising”, delete “a.top” and insert -- a top --.

UNITED STATES PATENT AND TRADEMARK OFFICE

CERTIFICATE OF CORRECTION

PATENT NO. : 6,516,569 B2
DATED : February 11, 2003
INVENTOR(S) : Falko Schweitzer It is certified that error appears in the above-identified patent and that said Letters Patent is hereby corrected as shown below:

Column 21,
Line 42, after "pushbutton" delete ",".

Signed and Sealed this

Twenty-ninth Day of July, 2003

JAMES E. ROGAN
*Director of the United States Patent and Trademark Office*